US005966881A

United States Patent [19]

Kitagaki

[11] Patent Number: 5,966,881

[45] Date of Patent: Oct. 19, 1999

[54] BASE PLATE FOR FOUNDATION AND FOUNDATION OF STRUCTURE

[75] Inventor: Nobuji Kitagaki, Tokyo, Japan

[73] Assignee: Mitsui Home Co., Ltd., Tokyo, Japan

[21] Appl. No.: 09/028,345

[22] Filed: Feb. 24, 1998

[30] Foreign Application Priority Data

Feb. 25, 1997 [JP] Japan ..... 9-041012

[51] Int. Cl.[6] ..... E02D 27/00

[52] U.S. Cl. ..... 52/293.3; 52/302.3; 248/346.01

[58] Field of Search ..... 52/293.3, 302.1, 52/302.3, 169.5, 293.1, 299, 262; 248/346.01

[56] References Cited

U.S. PATENT DOCUMENTS

| | | | |
|---|---|---|---|
| 254,489 | 3/1882 | Marks | 52/302.1 |
| 1,841,807 | 1/1932 | Harter | 52/302.3 |
| 2,616,529 | 11/1952 | MacDonald | 52/302.3 |
| 3,046,843 | 7/1962 | Rowe | 248/678 |
| 5,076,534 | 12/1991 | Adam | 248/678 |
| 5,749,555 | 5/1998 | Albrecht | 248/346.01 |

FOREIGN PATENT DOCUMENTS

| | | | |
|---|---|---|---|
| 83446 | 12/1919 | Switzerland | 52/302.3 |

*Primary Examiner*—Carl D. Friedman
*Assistant Examiner*—Dennis L. Dorsey
*Attorney, Agent, or Firm*—Liniak, Berenato, Longacre & White

[57] ABSTRACT

A base plate for foundation which is a board having a prescribed external size and possesses a bolt pore having an approximately cross shape at approximately the middle portion thereof and in which the top surface of the board except for the portion of the bolt pore has a prescribed area and a foundation of structure having the base plates for foundation arranged so that the area of projection chart thereof is minimized are provided.

28 Claims, 9 Drawing Sheets

BASE PLATE FOR FOUNDATION AND FOUNDATION OF STRUCTURE

BACKGROUND OF THE INVENTION

1. Field of the Invention

The present invention relates to a base plate for foundation used as a member for a method for ventilating a place under the floor in a structure, especially in a housing and relates to a foundation utilizing the same.

2. Prior Art

With regard to the effect of ventilating a place under the floor of a wooden house constructed by a mat foundation manner, it has been proven that the foundation packing method is highly effective for preventing the timber from being decayed in comparison with a manner of the ventilation through a ventilation hole and, thus, the technologies for a base plates for foundation in the foundation packing method have been developed. The term "foundation packing method" used herein means a method for inserting a base plate for foundation between a mat foundation and a wooden sill.

The foundation packing method is a method in which a base plate for foundation is provided between a mat foundation made of concrete and a wooden sill placed on the mat foundation. In this method, the ventilation of a place under the floor is carried out through dehumidification grooves placed on the base plate for foundation and through gaps formed by the right and left sides of the base plates, a mat foundation residing at a lower portion, and a wooden sill residing at an upper portion. In comparison with the ventilation through the ventilation holes, generally produced by hallowing out a foundation, the foundation packing method has the merits that there is no lacking in the section at the rise of the foundation, there is no need of a desiccant sheet because the sill is not in contact with the foundation, narrow portions, such as corners, can be ventilated, ventilation means can be placed at portions near the front door and terrace where the provision of the ventilation hole is not preferable in terms of the design, and the like. The base plate for foundation used for such a foundation packing method requires considerable compression strength, considerable weatherability, considerable dehumidification property, and the like.

Japanese examined patent application 55-40734 discloses a base plate for foundation composed of a plastic composite. The base plate for foundation disclosed therein is a board having a rectangle shape as a whole, and possesses grooves on the top and bottom surfaces for the purpose of the stabilization and of the ventilation and drainage, etc. Optionally the base plate for foundation may possess mortises and dovetail grooves for jointing two or more base plates for foundation at the forward and backward portions, and mortises and dovetail grooves for rectangularly jointing them at the side portions. Moreover, it also possesses a long pore for penetrating a bolt for fixing the wooden sill set on the mat foundation.

However, the base plate for foundation described above has the problems as follows:

(1) The base plate for foundation is desirable to be placed under a pillar C in the case of the conventional frame work as shown in FIG. 5, or placed under a vertical frame T in the case of the wood frame construction as shown in FIG. 6. However, when the base plates for foundation having a rectangle shape as a whole as in the case of the conventional plates are used so that each of the long sides of the base plate for foundation is arranged to be in consistence with the axis of the mat foundation and the wooden sill, the gaps formed by the base plates for foundation residing at the right and left positions, the mat foundation D and the wooden sill K, i.e., the area of the projecting chart of the open hole for ventilating a place under the floor, is decreased. Especially, in the case of frame work method, which must use a large number of the base plates for foundation, the problem associated with decrease in a ventilation effect becomes significant. For this reason, the effect of the ventilation of a place under the floor is decreased. This is overcome by decreasing the area of projection chart of the base plate for foundation, but when it is excessively decreased, the capability to support a load is unduly decreased.

(2) Since the conventional base plate for foundation possesses a long pore for penetrating an anchor bolt for fixing the wooden sill D on the mat foundation K, even if the anchor bolt is somewhat deviated from the correct position, the application can be done without any problem. However, the long pore disclosed therein, which is linear, is not applicable except for the deviation of the position only in one direction.

(3) The conventional base plate for foundation has grooves for ventilation and dehumidification on both of the top and bottom surfaces thereof, and the direction of each groove is in consistence with the lengthwise direction of the base plate for foundation. The air for ventilation and dehumidification, therefore, only flows in one direction, and thus, it cannot be said that the base plate for foundation is of effective ventilation performance. Furthermore, since the grooves are provided on both of the top and bottom surfaces, the area in contact with the mat foundation and the wooden sill is small, resulting in the problem associated with the capability to support a load and slip resistance. This is significant when the total size of the base plate for foundation is decreased.

(4) Since the conventional base plate for foundation possesses grooves for ventilation and dehumidification on both of the top and bottom surfaces thereof and is composed of a plastic composite, the surface thereof easily slips. In the case of using this plate, the foundation of the housing becomes unstable.

(5) In the course of the production of the conventional base plate for foundation, the mold release is carried out with clamping the ends of the base plate for foundation after the injection molding, the base plate for foundation itself is easily deformed, causing the problem to have an adverse influence upon the quality thereof in some extents.

SUMMARY OF THE INVENTION

The present invention has been made in light of the problems described under the items (1) to (5) mentioned above. An object of the present invention is, therefore, to provide a base plate for foundation having an enhanced effect of ventilating a place under the floor, an enhanced capability to support a load, and an increased slip resistance and being capable of making the application error to be in the tolerance level, and minimizing the deterioration in quality of the base plate for foundation during the course of the production by which the period of construction and the cost for construction are reduced, and to provide a foundation of housing which effectively utilizes the base plate for foundation thereby providing an inexpensive housing having a high quality to the public.

The present invention, therefore, relates to a base plate for foundation which is a board having a prescribed external size and possesses a bolt pore having an approximately cross shape at approximately the middle portion thereof and in which the top surface of the board except for the portion of the bolt pore has a prescribed area.

The "prescribed external size" used herein is one of the necessary requirements of the base plate for foundation according to the present invention, and means an external size which secures the area in contact with a mat foundation and a wooden sill required for supporting the load from the upper frames of structure and which minimizes the area as low as possible in order to maximize the effect of ventilating a place under the floor.

The second necessary requirement is to possess a bolt pore having an approximately cross shape at the middle portion of the board. Because of possessing such a pore, an anchor bolt for fixing a wooden sill onto a mat foundation can be fixed through the base plate for foundation as well as the deviation of the fixing bolt from the prescribed position generated during the course of the application in two directions can be permitted.

The third necessary requirement is that the top surface of the board except for the portion of the bolt pore possesses a prescribed area. To be specific, the area of the base plate for foundation in contact with a wooden sill residing at an upper portion of the base plate for foundation is secured at an area wider than a prescribed area.

As described above, the first necessary requirement and the third necessary requirement are disagreed with each other, and it is required to possess the two contrary properties with good balance. Therefore, this is reason why the terms "prescribed external size" and "prescribed area" are used herein.

The base plate for foundation according to the present invention is characterized in that a radial groove is provided on at least the bottom surface of the board from approximately the middle portion to the external edge.

The radial groove is mainly for the purpose of the dehumidification of the mat foundation. When a radial shape groove is provided, air can flow in the multiple directions. The groove should be carved on from approximately the middle portion to the external edges of the board. Otherwise, no air flows in the mat foundation in contact with the base plate for foundation, which has no meaning of the provision at all.

The term "at least the bottom surface" is intended to encompass only the bottom surface and both of the top surface and the bottom surface.

As described above, the base plate for foundation according to the present invention is a board having a minimum area required for supporting a load and having a construction where a groove effective for air flowing and dehumidification is carved on the bottom surface or the both of the top surface and the bottom surface.

On the other hand, the base plate for foundation according to the present invention may be a base plate for foundation wherein the board is a rectangle plane, and a groove carved parallel to the long side of the rectangle up to the external edge portions is provided on at least the bottom surface.

In this case, embodiments of the base plate for foundation can be contrived to enhance the effect of ventilation of a place under the floor.

In the base plate for foundation according to the present invention, by forming the top surface of the board as a frictional plane, the friction coefficient between the top surface of the base plate for foundation and the bottom surface of the wooden sill is increased. Since this makes it difficult to slip on the base plate for foundation and the wooden sill, even if the foundation is deformed by working an external force on the structure, the slippage of the base plate for foundation can be suppressed as little as possible.

Alternatively, when a plurality of projections are formed on the top surface of the board, the projections are stuck to the wooden sill. For this reason, even if the foundation is deformed by working an external force on the structure, the slippage of the base plate for foundation can be substantially prevented.

Furthermore, when chamfering portions are provided on four corners and a knob for mold release is provided on each of the chamfering portion, the deformation having an adverse influence upon the quality of the base plate for foundation can be suppressed as little as possible, when the mold release is carried out by picking the corners of the base plate for foundation after the injection molding during the course of the production.

The cross section of the bolt pore is inclined from the vertical plane, and can absorb the application error in the vertical direction even if the anchor bolt is somewhat slanted from the vertical direction in the case of applying the anchor bolt through the base plate for foundation.

When the board is of a square shape, the functions described above is well balanced, handling represented by transportation becomes easy, and the production cost can be reduced.

On the other hand, by arranging the base plate for foundation according to the present invention between the mat foundation and the wooden sill such a manner that the area of projection chart is as low as possible, the gaps formed by inserting the base plate for foundation between the mat foundation and the wooden sill, i.e., an effective area for the ventilation of a place under the floor, is maximized and, thus, the foundation of structure having a highly effective for ventilating a place under the floor can be formed.

BRIEF DESCRIPTION OF THE INVENTION

FIG. 9 shows an embodiment of using the base plate for foundation according to the present invention, wherein

PREFERRED EMBODIMENTS OF THE INVENTION

Embodiments of the base plate for foundation according to the present invention will now be described by referring to the attached drawings. In the description, to the same elements are applied the same symbols and the repetition description is omitted.

Figure 1A:
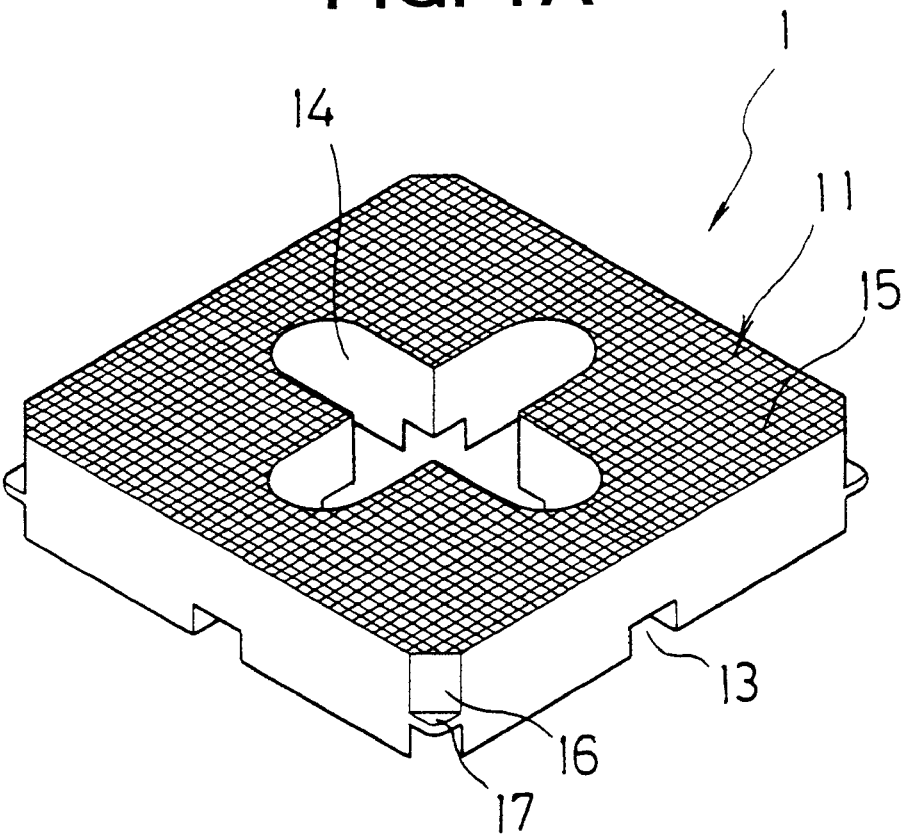
FIG. 1 is a perspective view which outlooks one embodiment of the base plate for foundation according to the present invention, wherein FIG. 1A mainly shows an upper portion and FIG. 1B mainly shows a lower portion.
Figure 1B:
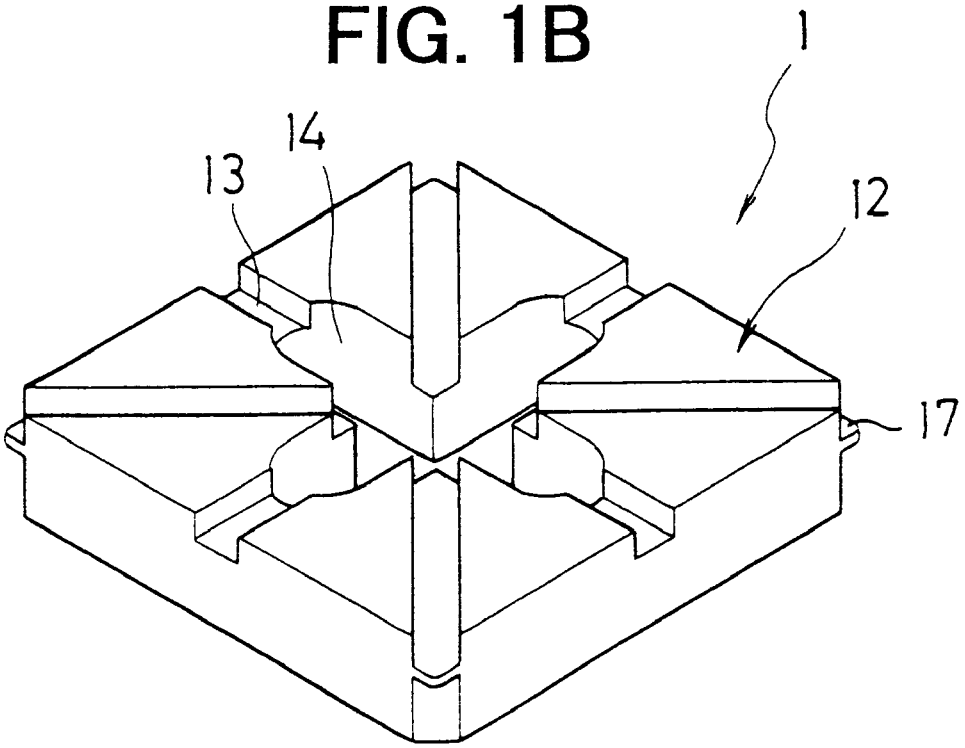

FIG. 1 is a perspective view which outlooks one embodiment of the base plate for foundation according to the present invention, wherein FIG. 1A mainly shows an upper portion and FIG. 1B mainly shows a lower portion.

In this drawing, a base plate 1 for foundation is a square board having a side of 100 mm. The area of the top surface 11 except for the portion of a bolt pore 14 is 80 $cm^2$. The bottom surface 12 has a radial dehumidification groove 13 at the middle portion thereof (see FIG. 2B).

The grounds why the area of the top surface having a side of 100 mm except for the portion of the bolt pore 14 is defined to be 80 $cm^2$ are as follows:

In the frame work, the size standard in each part is defined by the notification of the Ministry of Construction in Japan. In the case of a vertical frame used for the bearing wall, size standard No. 204 is usually applied (cross sectional size of 38 mm×89 mm as dry material). If the base plate 1 for foundation having an effective area bigger than the area corresponding to two vertical frames (total cross sectional size of 76 mm×89 mm as dry material), i.e., 67.74 $cm^2$ is used, even when the base plate 1 for foundation is inserted between the mat foundation and the wooden sill, the construction calculation in the case where no base plate 1 for foundation is inserted can be used. For this reason, as a size suitable for the production while securing the area corresponding to two vertical frames, the shape is defined to be a square having a side of 100 mm and the effective area in contact with the wooden sill is defined to be not less than 67.64 $cm^2$. The case where the total area of the vertical frames or the cross section of the pillar exceeds this effective contact area will be described latter on.

Larger the area of the projecting chart of the base plate 1 for foundation in the state where the base plate 1 for foundation is inserted between the mat foundation and the wooden sill is, smaller the gap generated by inserting the base plate 1 for foundation between the mat foundation/and the wooden sill, i.e., an effective area for ventilating a place under the floor formed by the adjacent base plates for foundation, the mat foundation and the wooden sill, is. Since this forms the foundation having a low effect of ventilation of a place under the floor, it is desirable to use the base plate 1 for foundation in such a manner that the area of the projecting chart of the base plate for foundation is minimized.

To be specific, from the viewpoint of the function of supporting a load, it is preferable for the base plate for foundation to have a large size and, conversely, from the viewpoint of the effect of ventilation of a place under the floor, the size of the base plate for foundation is preferably small. As the result of harmonizing these different requirements, the shape is defined to be a square having a side of 100 mm and the effective area in contact with the wooden sill is defined to be not less than 67.64 $cm^2$. In the present invention, it should be understood that the size and shape are not restricted thereto and any size and shape may be used as long as they meet the requirements described above.

In addition to the size and shape, the base plate 1 for foundation is required to have an appropriate strength in terms of material. A base plate 1 for foundation composed of the materials described in Japanese Patent Application 7-332319, which is our previously filed patent application, is assumed to be used herein, but the base plate 1 for foundation is not restricted thereto. For instance, the base plate for foundation composed of a plastic composite comprising 1 part by weight of a polyolefin and 1 to 10 parts by weight of powdered limestone as described in Japanese examined patent application 55-40734 may be used.

The base plate 1 for foundation possesses a bolt pore 14 having an approximately cross shape at the middle portion thereof. As described above, the bolt pore 14 is required for fixing the anchor bolt for fixing the wooden sill through the base plate 1 for foundation, and the deviation in two directions generated during the course of the application can be permitted through the bolt pore 14. Rounding the four points of the cross shape makes it possible to enlarge the area of the base plate 1 for foundation in contact with the wooden sill in comparison with the linear edges, the width in the deviation in the both cases being assumed to be the same.

On the bottom surface 12 of the base plate 1 for foundation, a radial dehumidification groove 13 is carved up to the external edges. By carving the dehumidification groove 13 having a radial shape up to the external edges, air can flow in the multiple directions of outside and inside of the foundation for the purpose of dehumidification of the mat foundation in contact with the base plate 1 for foundation.

In addition, the top surface 11 of the base plate 1 for foundation is formed as a friction plane 15. This makes it possible to effectively transmit the load, which is transmitted from the upper frames of the structure to the wooden sill, to the base plate 1 for foundation and to the mat foundation. The friction plane 15 may be formed by press molding during the production of the base plate 1 for foundation or by firmly adhering seal etc. onto the top surface 11 after the production.

Figure 8:
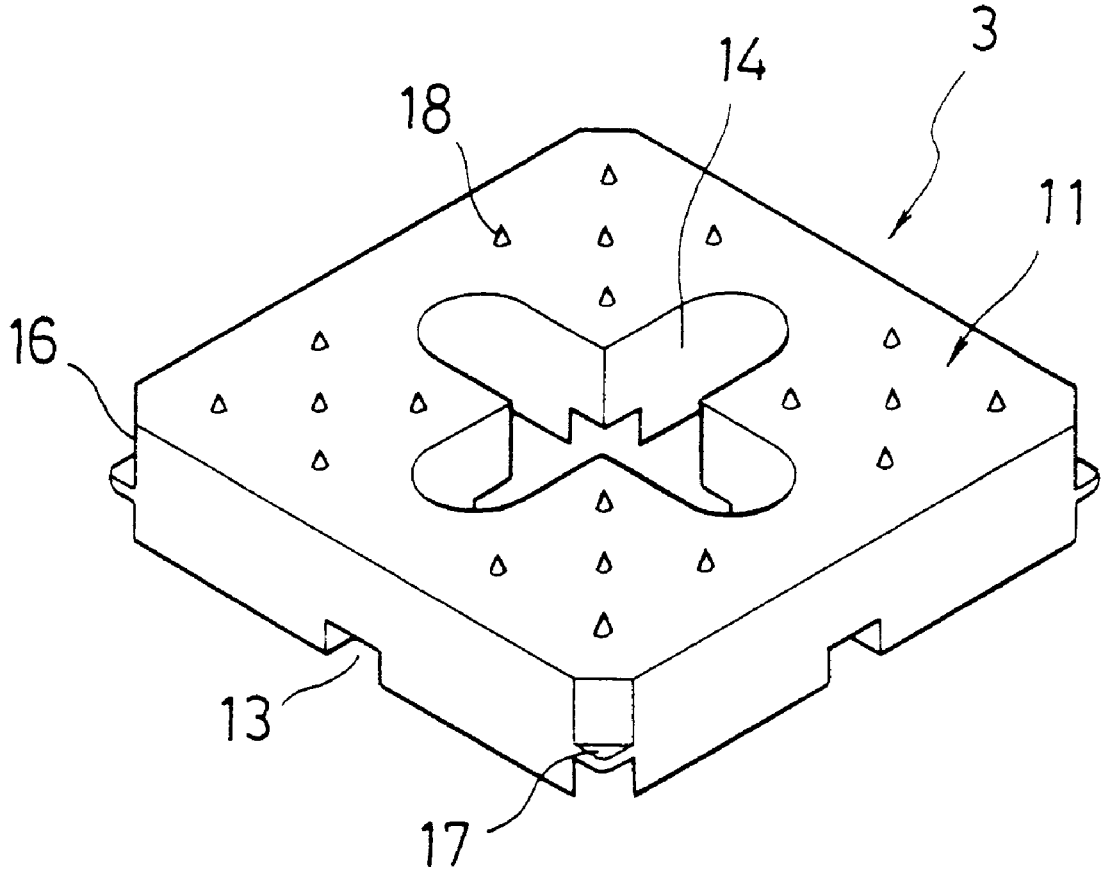
FIG. 8 is a perspective view which outlooks still another embodiment of the base plate for foundation according to the present invention, and mainly shows an upper portion.

On the other hand, as shown in FIG. 8, the base plate for foundation according to the present invention may be a base plate 3 for foundation having a plurality of projections 18 formed on the top surface 11. In this case, by sticking the projections 18 to the wooden sill, even if an external force is worked on the structure to deform the foundation, the slippage of the base plate 3 for foundation can be substantially prevented.

As shown in FIG. 1, chamfering portions 16 are provided on four corners and a knob 17 for mold release is provided on each of the chamfering portion 16. The knob 17 has an effect that the deformation which has an adverse influence upon the quality of the base plate for foundation can be suppressed as little as possible when the mold release is carried out by picking the corners of the base plate 1 for foundation after the injection molding during the course of the production. In order to provide the knob 17, the chamfering portion 16 is provided, and the base plate 1 for foundation is formed so that the total plane shape is within a square having a side of 100 mm.

Figure 2A:
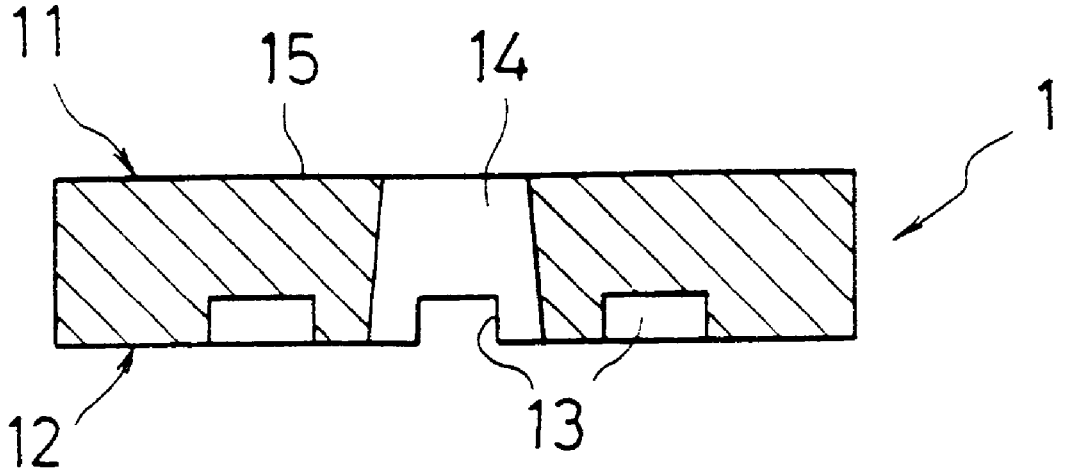
FIG. 2A is a longitudinal sectional view of the base plate for foundation shown in FIG. 1A
Figure 2B:
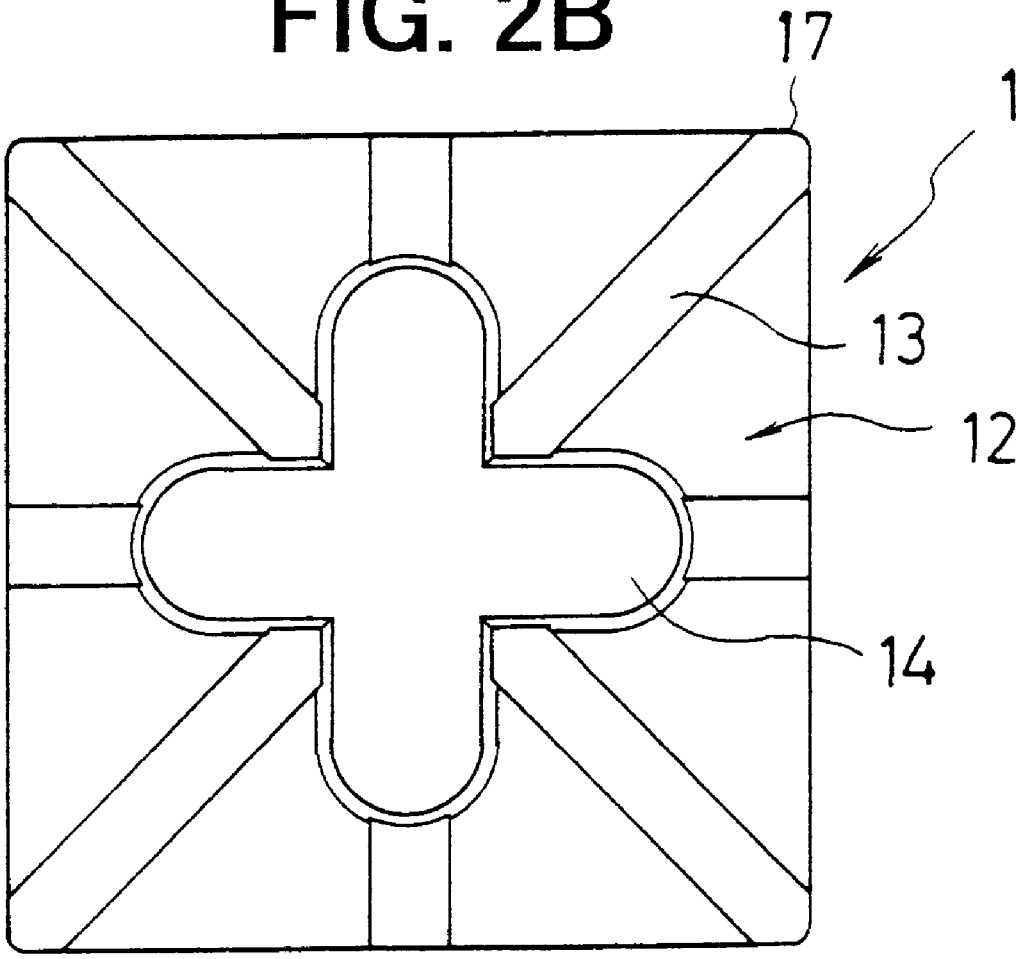
FIG. 2B is a longitudinal sectional view of the base plate for foundation shown in FIG. 1B.

As shown in FIG. 2A, the cross section of the bolt pore 14 is inclined from the vertical plane, in this case widening from the top surface 11 to the bottom surface 12. This makes it possible to permit the anchor bolt somewhat slanting from the vertical direction. To be specific, the deviation in the horizontal direction can be absorbed by the approximately cross shape possessed by the bolt pore 14 and the deviation in the vertical direction can be absorbed by widening from the top surface 11 to the bottom surface 12.

Here, since it is possible to increase the effective area of the top surface 11 of the base plate 1 for foundation in contact with the wooden sill as large as possible, it is desirable for the cross section of the bolt pore 14 to widen from the top surface 11 to the bottom surface 12 in this meaning.

Figure 3A:
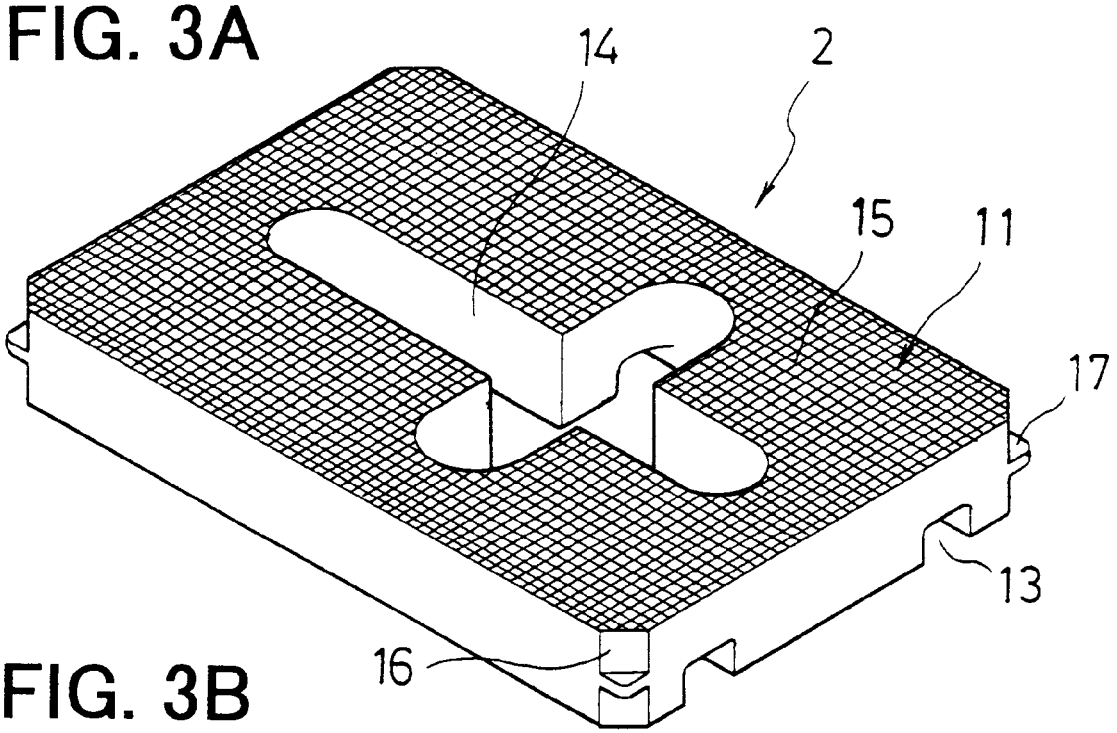
FIG. 3 is a perspective view which outlooks another embodiment of the base plate for foundation according to the present invention, wherein FIG. 3A mainly shows an upper portion and FIG. 3B mainly shows a lower portion.
Figure 3B:
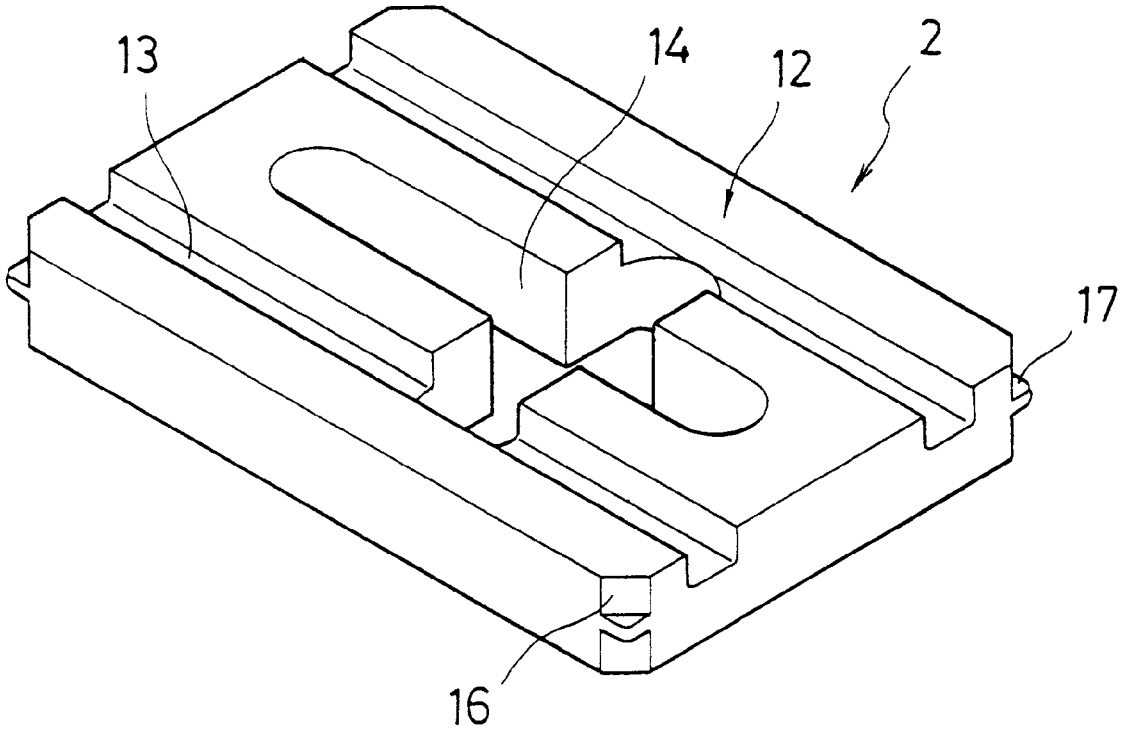
Figure 4A:
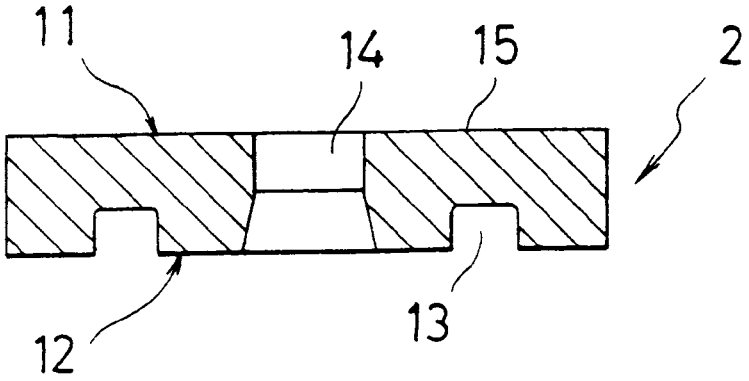
FIG. 4A is a longitudinal sectional view of the base plate for foundation shown in FIG. 3A
Figure 4B:
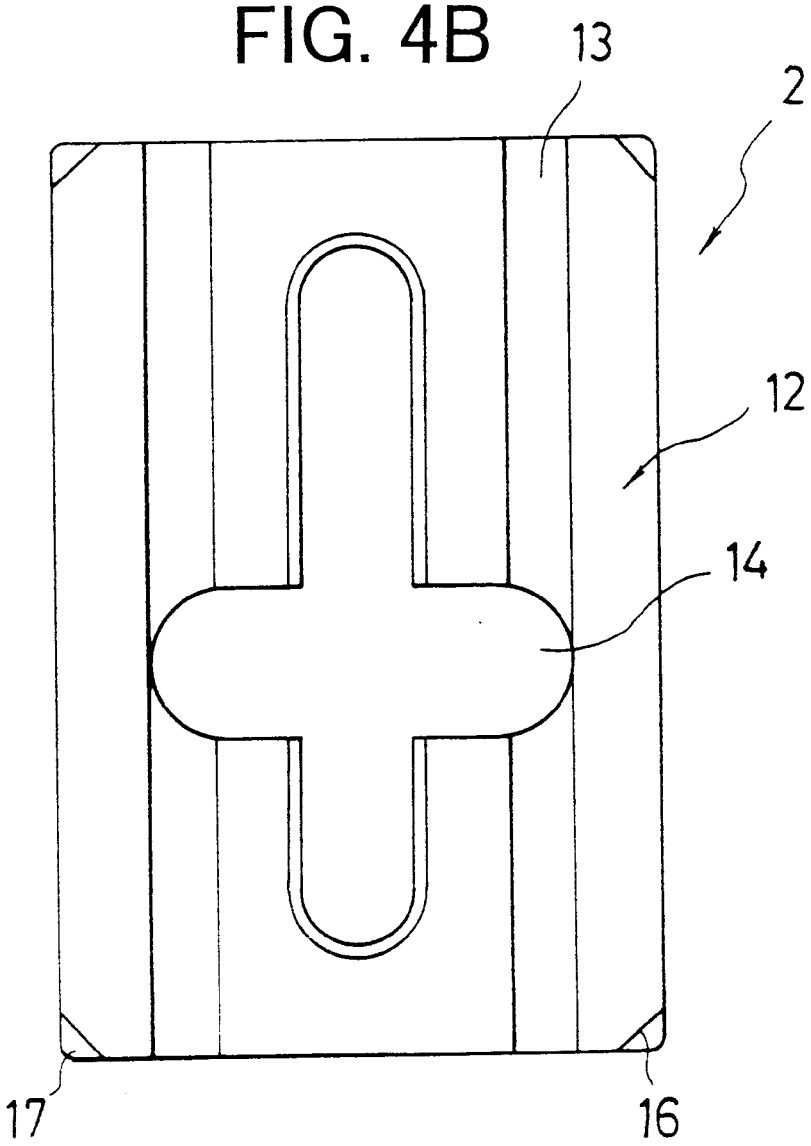
FIG. 4B is a longitudinal sectional view of the base plate for foundation shown in FIG. 3B.
Figure 5:
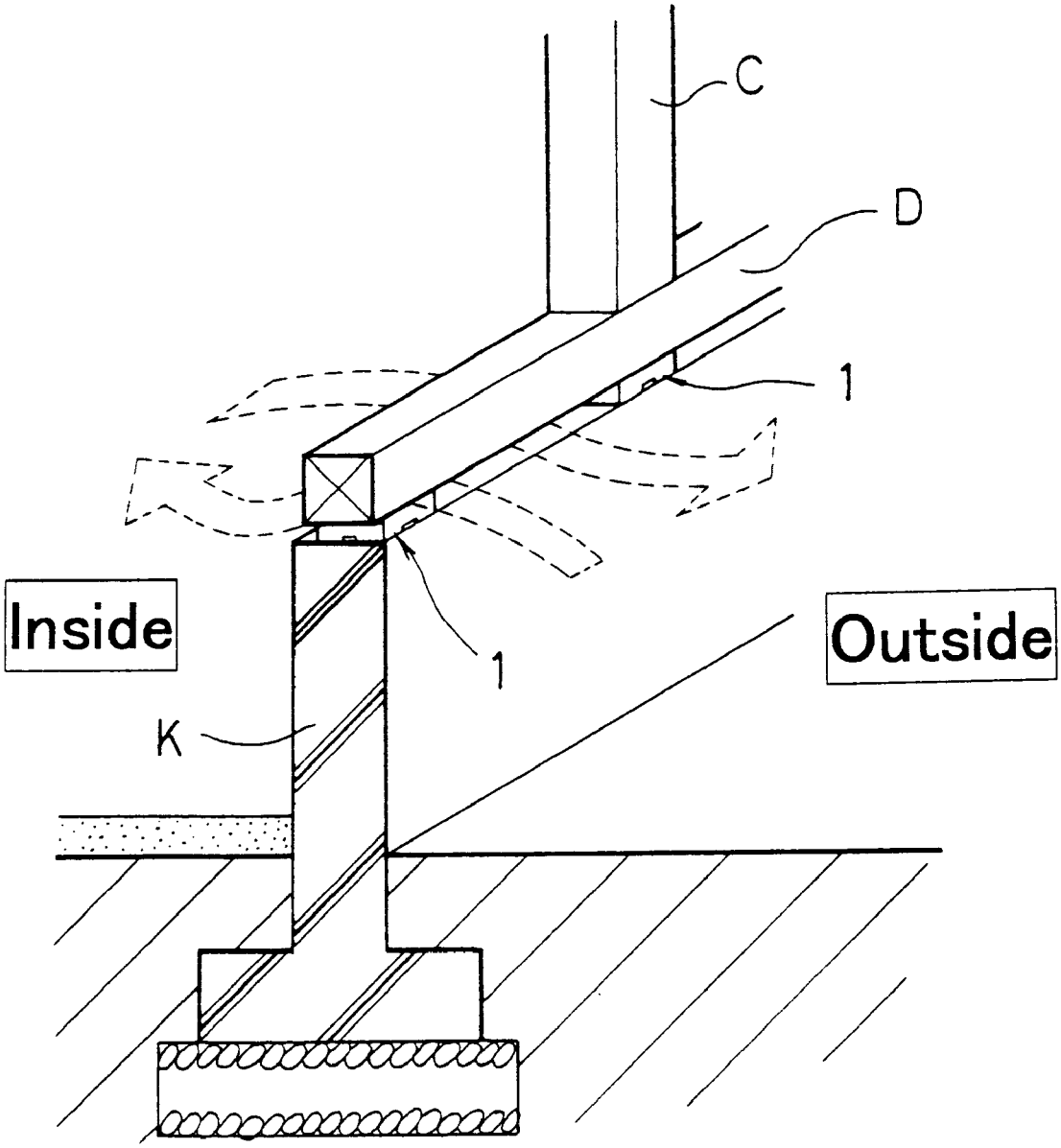
FIG. 5 is a partially sectional view showing an embodiment of using the base plate for foundation according to the present invention to the conventional frame work.
Figure 6:
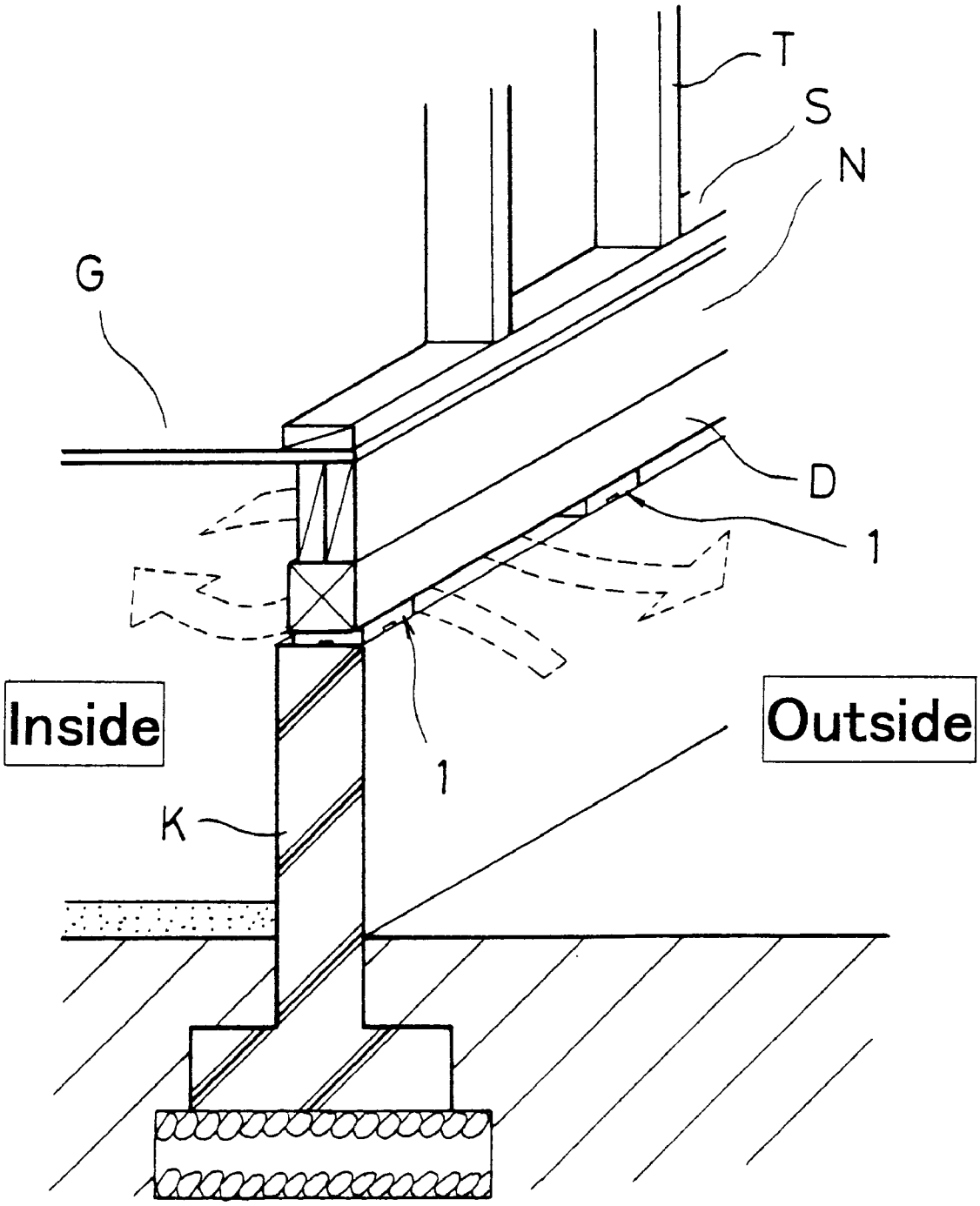
FIG. 6 is a partially sectional view showing an embodiment of using the base plate for foundation according to the present invention to the conventional wood frame construction.

On the other hand, whereas the base plate 1 for foundation shown in FIG. 1 is a square board having a side of 100 mm, in the case of using two frames (each having the size of 38 mm×140 mm and the total area being 106.4 $cm^2$) defined according to the size standard 206 of the frame for earthquake resisting wall in the wood frame construction or in the case of using a pillar having a cross section exceeding the required effective contact area described above in the conventional frame work, a base plate 2 for foundation as shown in FIG. 3 is used. This base plate 2 for foundation, which is a rectangle board having a size of 100 mm×150 mm, and in which the area of the top surface 11 except for the portion of the bolt pore 14 is 116 $cm^2$, is used in the case where the base plate 1 for foundation as shown in FIG. 1 is lacking in the effective contact area. The technical fields of the invention and the subjects to be solved concerned with the both of the base plates for foundation are the same, but the difference between them is the shape of the dehumidification groove 13 of the bottom surface 12. To be specific, in the base plate 2 for foundation as shown in FIG. 3, a plurality of the dehumidification grooves are formed parallel to the lengthwise direction of the base plate 2 for foundation.

Figure 9A:
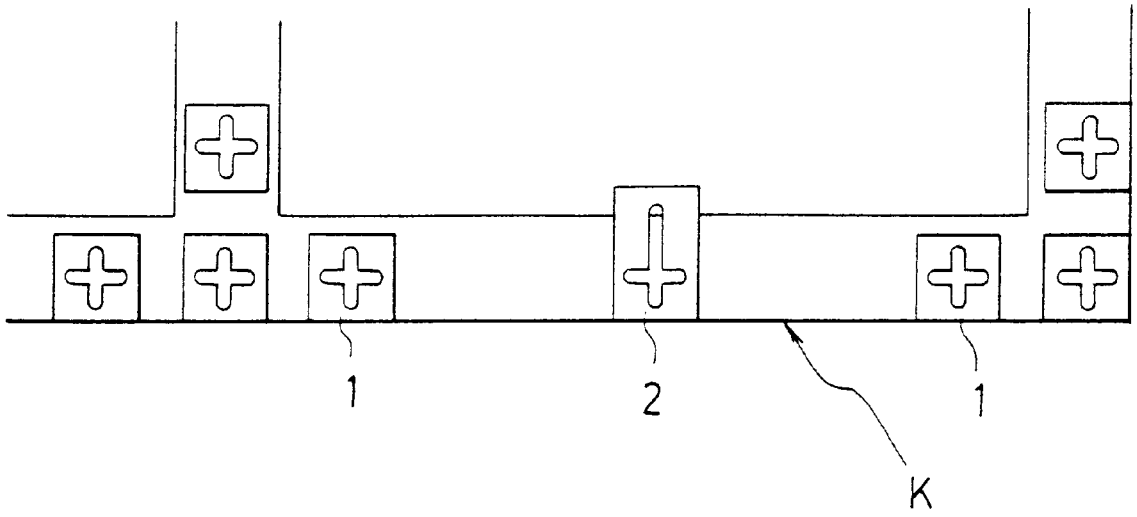
FIG. 9A is a plane view and FIG. 9B is a sectional view.
Figure 9B:
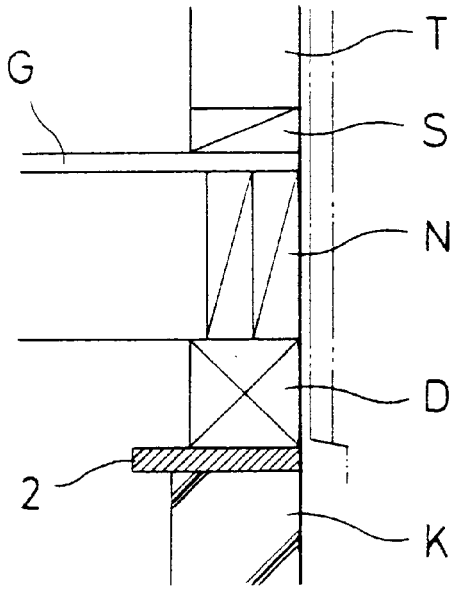

The attentive point here is that the base plate 2 for foundation is arranged such that the widthwise direction is faced to the outside as shown in FIG. 9A, i.e., the effective area for ventilating a place under the floor formed by the distance between the base plates 2 for foundation is maximized. When the base plate 2 for foundation is arranged as described above, the area required for supporting a load is secured and the base plate 2 for foundation can be used so that the effective area for ventilating a place under the floor is maximized. What is more, the dehumidification groove 13 is in the direction directly connecting the outside and the inside, which is effective for ventilating a place under the floor.

Figure 7:
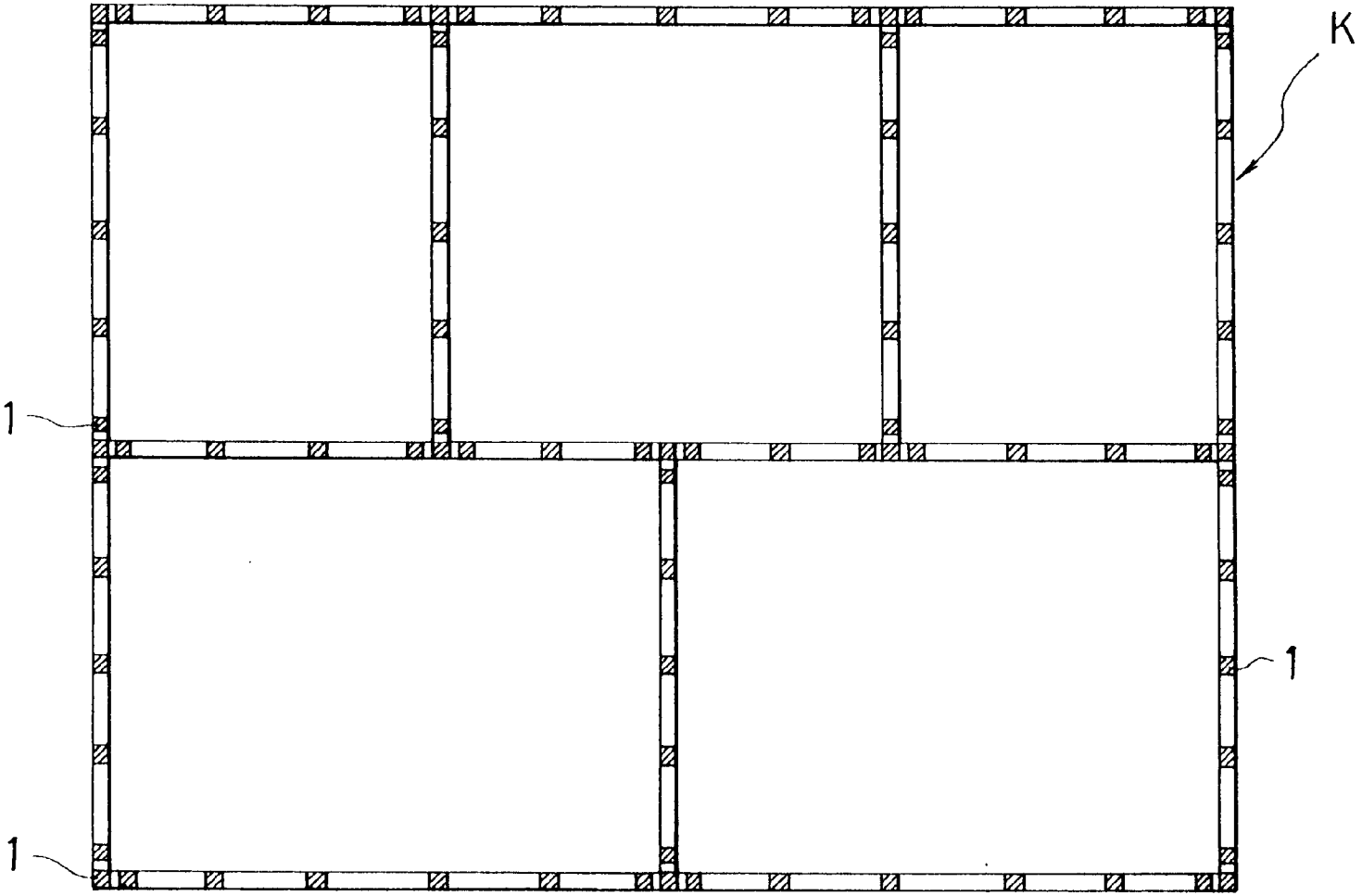
FIG. 7 is a plane view which shows the plane arrangement of the base plate for foundation according to the present invention.

Examples of the arrangement of the base plate 1, 2, or 3 for foundation according to the present invention are shown in FIG. 7, wherein the numeric 1 is used for the base plate for foundation in FIG. 7 and in the following description.

FIG. 7 assumes the housing constructed by the conventional frame work, and symbol K indicates the mat foundation. The base plate 1 for foundation is placed on the mat foundation K. It is preferable to place the base plate 1 for foundation according to the following rules:

(1) The base plate 1 for foundation is placed on the cross point of the bearing wall lines in principle, because the cross point of the bearing wall lines easily undergoes a concentrated load, and if there is a gap at this portion, the foundation has a tendency to be totally deformed.

(2) At least one base plate 1 for foundation is placed on the portion where the anchor bolt is provided. Since the base plate 1 for foundation is required to be fixed onto the mat foundation K, the base plate 1 for foundation is placed on the portion where the anchor bolt resides, and is fixed by the use of an adhesive, etc. Further, the base plate 1 for foundation on which no anchor bolt resides is also fixed onto the mat foundation K by the use of an adhesive, etc.

Other rules are as follows:

(3) Under the portion to which a concentrated load is applied such as base for lintel, at least one base plate 1 for foundation is placed within the range of transmitting the load.

(4) In the case where an access hole etc. is provided on the rise of the mat foundation K, one base plate for foundation is placed on each of the both ends of the open hole.

(5) As for the portions except for the portions described above, one base plate 1 for foundation is placed per 50 cm as a rule. The distance between two base plates 1 for foundation is at most 75 cm. The portions except for bearing wall and supporting wall are not restricted thereto.

On the other hand, in the case of the housing constructed by the conventional wood frame construction, in the item (3) described above, the portions to which a concentrated load is applied such as a pillar and a diagonal brace, the base plate 1 for foundation should be placed, and in the item (5) the distance between the base plate 1 for foundation is within 1 m. Otherwise, the same rules as described in items (1) to (5) are applicable.

While the base plate for foundation according to the present invention and the foundation of the structure using the same are described, the present invention is not restricted to the embodiments described above. For instance, the present invention totally includes the base plates for foundation having areas of the top surface and the bottom surface different from each other, those which are boards having various shapes such as triangle and various polygons, those having a different radial shape, those having a different shape and/or a different pattern of the friction plane, those having a different shape of the projection, a different number and/or a different arrangement of the projections, those having a different shape of the chamfering portion and/or a different shape or a different size of the knob for mold releasing, those having a different inclination of the bolt pore, and the like. The base plate for foundation according to the present invention can be used not only for housing but also for any other applications of structure utilizing the foundation manner.

As described above, the base plate for foundation according to the present invention satisfies the different requirements in the foundation packing method, i.e., the effect of ventilation of a place under the floor, capability to support a load, and slip resistance, brings out the maximum performance of each requirement, absorbs the application error, and suppresses the deterioration in quality during the production to the minimum level.

As a result, the period of construction work and the cost for construction can be reduced. Furthermore, by effectively using the base plate for foundation to form a good foundation having a long service life, an inexpensive housing having a high quality can be provided.

What is claimed is:

1. A base plate for foundation which is in the form of a substantially square and planar plate member, the base plate having an approximately cross shaped bolt hole extending through the thickness of and located at a central area of the plate member, a top surface of the plate member reduced by the area of the bolt hole, and at least a bottom surface of the plate member being provided with radial grooves extending from the central area toward external edge portions thereof.

2. A foundation of structure having the base plates for foundation as claimed in claim 1 disposed between a mat foundation and a wooden sill of the structure, wherein each base plate is located so that an area extending vertically between said mat foundation and said wooden sill is minimized.

3. The base plate for foundation as claimed in claim 1, wherein shallow grooves are provided throughout the top surface of the plate member so that a friction plane is formed on the base plate.

4. The base plate for foundation as claimed in claim 3, wherein chamfering portions are formed at corners of the plate member, and a mold release knob is formed at the respective chamfering portions.

5. The base plate for foundation as claimed in claim 4, wherein an inner wall surface of said bolt hole inclines to a vertical plane.

6. The base plate for foundation as claimed in claim 3, wherein an inner wall surface of said bolt hole inclines to a vertical plane.

7. A foundation of structure having the base plates for foundation as claimed in claim 3 disposed between a mat foundation and a wooden sill of the structure, wherein each base plate is located so that an area extending vertically between said mat foundation and said wooden sill is minimized.

8. The base plate for foundation as claimed in claim 1, wherein a plurality of pointed projections are formed on the top surface of the plate member.

9. The base plate for foundation as claimed in claim 8, wherein chamfering portions are formed at corners of the plate member, and a mold release knob is formed at the respective chamfering portions.

10. The base plate for foundation as claimed in claim 9, wherein an inner wall surface of said bolt hole inclines to a vertical plane.

11. The base plate for foundation as claimed in claim 8, wherein an inner wall surface of said bolt hole inclines to a vertical plane.

12. A foundation of structure having the base plates for foundation as claimed in claim 8 disposed between a mat foundation and a wooden sill of the structure, wherein each base plate is located so that an area extending vertically between said mat foundation and said wooden sill is minimized.

13. The base plate for foundation as claimed in claim 1, wherein chamfering portions are formed at corners of the plate member, and a mold release knob is formed at the respective chamfering portions.

14. A foundation of structure having the base plates for foundation as claimed in claim 13 disposed between a mat foundation and a wooden sill of the structure, wherein each base plate is located so that an area extending vertically between said mat foundation and said wooden sill is minimized.

15. The base plate for foundation as claimed in claim 1, wherein an inner wall surface of said bolt hole inclines to a vertical plane.

16. A foundation of structure having the base plates for foundation as claimed in claim 15 disposed between a mat foundation and a wooden sill of the structure, wherein each base plate is located so that an area extending vertically is minimized.

17. A base plate for foundation which is in the form of a substantially rectangular and planar plate member, the base plate including an approximately cross shaped bolt hole extending through the thickness of and located at a central area of the plate member, a top surface of the plate member reduced by the area of the bolt hole, the plate member being provided at the bottom surface with grooves extending paralled along through the longitudinal direction of the plate member, and the base plate being provided throughout a top surface of the plate member with shallow grooves so as to form a friction plane.

18. The base plate for foundation as claimed in claim 17, wherein an inner wall surface of said bolt hole inclines to a vertical plane.

19. A foundation of structure having the base plates for foundation as claimed in claim 17 disposed between a mat foundation and a wooden sill of the structure, wherein each base plate is located so that an area extending vertically between said mat foundation and said wooden sill is minimized.

20. The base plate for foundation as claimed in claim 17, wherein chamfering portions are formed at corners of the plate member, and a mold release knob is formed at the respective chamfering portions.

21. The base plate for foundation as claimed in claim 20, wherein an inner wall surface of said bolt hole inclines to a vertical plane.

22. A foundation of structure having the base plates for foundation as claimed in claim 20 disposed between a mat foundation and a wooden sill of the structure, wherein each base plate is located so that an area extending vertically between said mat foundation and said wooden sill is minimized.

23. A base plate for foundation which is in the form of a substantially rectangular and planar plate member, the base plate including an approximately cross shaped bolt hole extending through the thickness of and located at a central area of the plate member, a top surface of the plate member is reduced by the area of the bolt hole, the plate member being provided it a bottom surface with grooves extending paralled along through the longitudinal direction of the plate member, and a plurality of pointed projections being formed on the top surface of the plate member.

24. The base plate for foundation as claimed in claim 23, wherein an inner wall surface of said bolt hole inclines to a vertical plane.

25. A foundation of structure having the base plates for foundation as claimed in claim 23 disposed between a mat foundation and a wooden sill of the structure, wherein each base plate is located so that an area extending vertically between said mat foundation and said wooden sill is minimized.

26. The base plate for foundation as claimed in claim 23, wherein chamfering portions are formed at corners of the plate member, and a mold release knob is formed at the respective chamfering portions.

27. The base plate for foundation as claimed in claim 26, wherein an inner wall surface of said bolt hole inclines to a vertical plane.

28. A foundation of structure having the base plates for foundation as claimed in claim 26 disposed between a mat foundation and a wooden sill of the structure, wherein each base plate is located so that an area extending vertically is minimized.

* * * * *

UNITED STATES PATENT AND TRADEMARK OFFICE

CERTIFICATE OF CORRECTION

PATENT NO. : 5,966,881
DATED : October 19, 1999
INVENTOR(S) : Kitagaki

It is certified that error appears in the above-identified patent and that said Letters Patent is hereby corrected as shown below:

Title page,
Item [73], should read -- [73] Assignee: Mitsui Chemicals, Inc., Tokyo, Japan --

Signed and Sealed this

Fifth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,966,881
DATED : October 19, 1999
INVENTOR(S) : Kitagaki

It is certified that error appears in the above-identified patent and that said Letters Patent is hereby corrected as shown below:

Title page,
Item [73], Assignee should read as follows:

-- [73] Assignee: Mitsui Home Co., Inc.; Mitsui Chemicals, Inc., both of Tokyo, Japan --.

This certificate supersedes Certificate of Correction issued November 5, 2002.

Signed and Sealed this

Seventeenth Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 5,966,881
DATED : October 19, 1999
INVENTOR(S) : Kitagaki

It is certified that error appears in the above-identified patent and that said Letters Patent is hereby corrected as shown below:

Title page,
Item [73], Assignee should read as follows:

-- [73] Assignee: Mitsui Home Co., LTD.; Mitsui Chemicals, Inc., both of Tokyo, Japan --.

This certificate supersedes Certificate of Correction issued December 17, 2002.

Signed and Sealed this

First Day of April, 2003

JAMES E. ROGAN
*Director of the United States Patent and Trademark Office*